US005965495A

United States Patent [19]

Goto et al.

[11] Patent Number: 5,965,495

[45] Date of Patent: Oct. 12, 1999

[54] LUBRICATING OIL COMPOSITION FOR INTERNAL COMBUSTION ENGINES

[75] Inventors: Masahisa Goto; Tomomi Miyaji, both of Ichihara, Japan

[73] Assignee: Idemitsu Kosan Co., Ltd., Tokyo, Japan

[21] Appl. No.: 08/913,105

[22] PCT Filed: Mar. 13, 1996

[86] PCT No.: PCT/JP96/00620

§ 371 Date: Sep. 15, 1997

§ 102(e) Date: Sep. 15, 1997

[87] PCT Pub. No.: WO96/28526

PCT Pub. Date: Sep. 19, 1996

[30] Foreign Application Priority Data

Mar. 14, 1995 [JP] Japan ..... 7-054608

[51] Int. Cl.[6] ..... C10M 141/12

[52] U.S. Cl. ..... 508/192; 508/479; 508/480; 508/501; 508/502; 508/503

[58] Field of Search ..... 508/192, 501, 508/502, 503, 479, 480

[56] References Cited

U.S. PATENT DOCUMENTS

| | | | |
|---|---|---|---|
| 5,458,807 | 10/1995 | Tamoto | 508/192 |
| 5,525,247 | 6/1996 | Miyaji et al. | 508/192 |
| 5,629,272 | 5/1997 | Nakazato et al. | 508/192 |
| 5,631,212 | 5/1997 | Vrahopoulou | 508/192 |
| 5,658,862 | 8/1997 | Vrahopoulou | 508/192 |
| 5,672,570 | 9/1997 | Miyaji et al. | 508/502 |
| 5,672,572 | 9/1997 | Arai et al. | 508/518 |
| 5,686,398 | 11/1997 | Minokami et al. | 508/502 |

FOREIGN PATENT DOCUMENTS

| | | |
|---|---|---|
| 0 562 172 | 9/1993 | European Pat. Off. . |
| 0 609 623 | 8/1994 | European Pat. Off. . |

*Primary Examiner*—Ellen M. McAvoy
*Attorney, Agent, or Firm*—Oblon, Spivak, McClelland, Maier & Neustadt, P.C.

[57] ABSTRACT

A lubricating oil composition for internal combustion engines which comprises a base oil, (a) an ashless dispersant containing boron, (b) a metallic detergent, and optionally (c) at least one selected from a group consisting of esters of aromatic carboxylic acids having hydroxyl group and hydroxy compounds and compounds containing boron which are derived from the esters, wherein a ratio [B]/[M] of a content of boron [B] in the composition in % by weight to a total content of metals [M] derived from the detergent in the composition in % by weight is not less than 0.15, and a sulfated ash content in the composition is not more than 1.5% by weight. The lubricating oil composition has a low ash content, does not show adverse effects on the performance of apparatuses for exhaust gas treatment, and exhibits excellent resistance to coking and oxidation stability.

15 Claims, No Drawings

LUBRICATING OIL COMPOSITION FOR INTERNAL COMBUSTION ENGINES

TECHNICAL FIELD

The present invention relates to a lubricating oil composition for internal combustion engines, more particularly, to lubricating oil composition which has a low ash content, does not show adverse effects on the performance of apparatuses for exhaust gas treatment, and exhibits excellent resistance to coking and oxidation stability, and still more particularly, to a lubricating oil composition advantageously used for Diesel engines and gas engine heat pumps (GHP).

BACKGROUND ART

In recent years, environmental pollution caused by nitrogen oxides ($NO_x$ gases) and particulate materials (PM) which are discharged from internal combustion engines, particularly Diesel engines, is an important problem, and decreasing nitrogen oxides and particulate materials in exhaust gas is urgently required.

For overcoming the problem, exhaust gas recirculation (EGR) and lowering of the peak temperature of combustion by delaying time of fuel injection are examined for decreasing $NO_x$ gases.

However, when the peak temperature of combustion is lowered, black smoke and PM are increased, and attaching an apparatus for exhaust gas treatment becomes necessary. As the apparatus for exhaust gas treatment, PM traps or oxidation catalysts are examined. Because these apparatuses have a structure of a filter, clogging by metal components in oil causes a problem when conventional Diesel engine oil is used.

In lubricating oil compositions for internal combustion engines, an ashless dispersant and a metallic detergent are generally contained as the essential components. However, decrease in metallic components is desired because of the problem of clogging, as described above. This causes another problem in that excellent effects of keeping an engine clean and preventing formation of deposit become difficult to be obtained when metallic detergent is not used or used in a small amount.

DISCLOSURE OF THE INVENTION

Under the above circumstances, the present invention has an object of providing a lubricating oil composition for internal combustion engines which has a small ash content, does not show adverse effect on the performance of apparatuses for exhaust gas treatment, such as oxidation catalysts and PM traps, and moreover, exhibits excellent resistance to coking and oxidation stability.

As the result of extensive studies conducted by the present inventors to develop a lubricating oil composition for internal combustion engines having the above desirable properties, it was discovered that resistance to coking and oxidation stability are improved when a lubricating oil composition comprises a metallic detergent in an amount smaller than that in conventional compositions and an ashless dispersant containing boron in a specific amount or more relative to the amount of the metallic dispersant, and that these properties are further improved when a lubricating oil composition additionally comprises an ester of an aromatic carboxylic acid having hydroxyl group and a hydroxy compound or a compound containing boron which is derived from the ester. The present invention has been completed on the basis of the discovery.

Accordingly, the present invention provides a lubricating oil composition for internal combustion engines which comprises a base oil, (a) an ashless dispersant containing boron, (b) a metallic detergent, and optionally (c) at least one selected from a group consisting of esters of aromatic carboxylic acids having hydroxyl group and hydroxy compounds and compounds containing boron which are derived from the esters, wherein a ratio [B]/[M] of a content of boron [B] in the composition in % by weight to a total content of metals [M] derived from the detergent in the composition in % by weight is not less than 0.15, and a sulfated ash content in the composition is not more than 1.5% by weight.

THE MOST PREFERRED EMBODIMENT TO CARRY OUT THE INVENTION

As the base oil in the lubricating oil of the present invention, mineral oil or synthetic oil is generally used. The type and the properties of the mineral oil and the synthetic oil are not particularly limited. A mineral oil or a synthetic oil having a kinematic viscosity in the range of 1.5 to 40 $mm^2$/sec at 100° C. is generally used. Examples of the mineral oil include paraffinic mineral oils, intermediate mineral oils, and naphthenic mineral oils obtained by an ordinary process of purification, such as solvent purification and hydro-refining.

Examples of the synthetic oil include polybutene, polyolefins ((co)polymers of α-olefins), various types of ester (such as polyolesters, esters of dibasic acids, and esters of phosphoric acid), various types of ether (such as polyphenyl ether), alkylbenzenes, and alkylnaphthalenes.

In the present invention, a single type or a combination of two or more types of the above mineral oil can be used as the base oil. A single type or a combination of two or more types of the above synthetic oil can also be used as the base oil. Moreover, a combination of one or more types of the mineral oil and one or more types of the above synthetic oil can be used.

In the lubricating oil composition of the present invention, an ashless dispersant containing boron is used as component (a). The ashless dispersant containing boron is not particularly limited, and various types of conventional ashless dispersant can be used. Examples of the ashless dispersant containing boron include (1) ashless dispersants obtained by treating alkenylsuccinimides or alkylsuccinimides with boron compounds, (2) ashless dispersants obtained by treating alkenylsuccinamides or alkylsuccinamides with boron compounds, (3) ashless dispersants obtained by treating alkenylbenzylamines or alkylbenzylamines with boron compounds, (4) ashless dispersants obtained by treating fatty acid amides with boron compounds, and (5) ashless dispersants obtained by treating esters of succinic acid with boron compounds.

The alkenylsuccinimide or the alkylsuccinimide used for ashless dispersant (1) can be obtained by reacting an alkenylsuccinic anhydride, an alkylsuccinic anhydride, an alkenylsuccinic acid, or an alkylsuccinic acid with a polyamine. The alkenyl group is a group which is derived from a polymer of an olefin having 2 to 15 carbon atoms and has a molecular weight of 200 to 4,000, preferably 500 to 3,000, more preferably 700 to 2,300. The alkenyl group is preferably polybutenyl group or polyisobutenyl group.

The alkenyl group may be hydrogenated to an alkyl group. Examples of the polyamine include polyalkylenepolyamines, preferably polyethylenepolyamines. Specific examples of the polyethylenepolyamine include diethylenetriamine, triethylenetetramine, tetraethylenepentamine, and pentaethylenehexamine. A single type or a mixture of two or more types of the polyamine can be used.

Further examples of the alkenylsuccinimide and alkylsuccinimide include compounds obtained by condensation of the above alkenylsuccinimides or alkylsuccinimides with aromatic compounds in accordance with Mannich's condensation. Particularly preferable examples of the aromatic compound include alkylphenols and alkylphenol sulfides.

The alkyl group in the alkylphenol may be an alkyl group having 3 to 30 carbon atoms. Specific examples of the alkylphenol include butylphenol, octylphenol, nonylphenol, dodecylphenol, hexadecylphenol, and eicosylphenol. The alkylphenol sulfides are sulfurization products of alkylphenols.

As the above alkenylsuccinimide, polybutenylsuccinimide which is a reaction product of polybutenyl succinic acid (anhydride) and a polyethylenepolyamine and compounds derived from the polybutenylsuccinimide and the alkylphenol or the alkylphenol sulfide are preferably used.

The alkenylsuccinimide or the alkylsuccinimide used in ashless dispersant (2) can be obtained from an alkenylsuccinic acid or an alkylsuccinic acid and a polyamine. The alkenyl group and the alkyl group are the same as those described above for ashless dispersant (1). Examples of the polyamine include the same compounds as those described above for ashless dispersant (1). A single type or a mixture of two or more types of the polyamine can be used.

The alkenyl group and the alkyl group in the alkenylbenzylamine or the alkylbenzylamine (condensation products of phenol substituted with an alkenyl or alkyl group, aldehydes, and amines) used in ashless dispersant (3) are the same as those described for ashless dispersant (1).

The fatty acid amide used in ashless dispersant (4) can be obtained from a fatty acid and a polyamine. As the fatty acid, a saturated or unsaturated linear or branched carboxylic acid having 8 to 22 carbon atoms is preferably used. Examples of the polyamine include the same compounds as those described for ashless dispersant (1). A single type or a mixture of two or more types of the polyamine can be used.

The ester of succinic acid used in ashless dispersant (5) can be obtained from succinic acid and preferably an alcohol having 2 to 50 carbon atoms.

Examples of the boron compounds used in ashless dispersants (1) to (5) include boric acid, boric anhydride, boron halides, esters of boric acid, amides of boric acid, and boron oxide.

The ashless dispersant containing boron preferably contains boron in an amount in the range of 0.1 to 3% by weight. A single type or a combination of two or more types of the ashless dispersant containing boron can be used.

In the lubricating oil composition of the present invention, the ashless dispersant containing boron of component (a) is generally comprised in an amount of 1 to 20% by weight of the total weight of the composition. When the amount is less than 1% by weight, an engine is not kept clean sufficiently. When the amount is more than 20%, viscosity is increased. Thus, such an amount is not preferable. From the standpoint of the property to keep an engine clean and the suitable viscosity, the amount of the ashless dispersant containing boron is preferably in the range of 2 to 12% by weight, more preferably in the range of 2 to 8% by weight.

In the lubricating oil composition of the present invention, a metallic detergent is used as component (b). The metallic detergent is not particularly limited, and a conventional metallic detergent can be used. Examples of the metallic detergent include sulfonates, phenates, salicylates, and phosphonates of alkali metals and alkaline earth metals. Examples of the alkali metal include sodium and potassium. Example of the alkaline earth metal include calcium, barium, and magnesium.

The metallic detergent generally has a total base number (TBN) (measured in accordance with Japanese Industrial Standard K-2501, the perchloric acid method) in the range of 10 to 500 mg KOH/g, preferably in the range of 30 to 350 mg KOH/g.

In the composition of the present invention, a single type or a combination of two or more types of the metallic detergent can be used. For exhibiting the effect of the present invention more fully, it is preferable that one or more compounds selected from the group consisting of alkali metal salicylates and alkaline earth metal salicylates are used as the metallic detergent, or that a combination of one or more compounds selected from the group consisting alkali metal salicylates and alkaline earth metal salicylates and one or more compounds selected from alkali metal phenates, alkaline earth metal phenates, alkali metal sulfonates, and alkaline earth metal sulfonates is used as the metallic detergent.

In the lubricating oil composition of the present invention, the metallic detergent of component (b) is generally comprised in an amount of 0.5 to 20% by weight of the total weight of the composition. When the amount is less than 0.5% by weight, an engine is not kept clean sufficiently. When the amount is more than 20% by weight, clogging in an apparatus for exhaust gas treatment takes place. Thus, such an amount is not preferable. From the standpoint of keeping an engine clean and suppressing clogging in an apparatus for exhaust gas treatment, the amount of the metallic detergent is preferably in the range of 0.5 to 10% by weight, more preferably in the range of 1 to 5% by weight.

In the lubricating oil composition of the present invention, an ester of an aromatic carboxylic acid and a hydroxy compound and/or a compound containing boron which is derived from this ester can be comprised optionally as component (c) for exhibiting the effect of the present invention more fully. The above ester and the above compound containing boron have the function of an ashless detergent having excellent stability at high temperatures.

Preferable examples of the above ester include esters obtained by reacting an aromatic carboxylic acid having hydroxyl group which is represented by the following general formula (I):

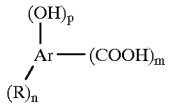

(I)

wherein Ar represents a polyvalent aromatic nucleus, R represents an organic group, p represents an integer of 1 to 3, n represents an integer of 1 to 4, m represents an integer of 1 to 3, and when a plurality of R are present, the plurality of R may be the same with each other or different from each other, with an alcohol having 2 to 80 carbon atoms.

In above general formula (I), Ar represents a polyvalent aromatic nucleus. Examples of the polyvalent nucleus include nuclei derived from benzene, naphthalene, anthracene, phenanthrene, indene, fluorene, and biphenyl. Among these nuclei, nuclei derived from benzene and naphthalene are preferable. Ar may occasionally have substituents, such as halogen atoms, nitro group, and mercapto group, in addition to hydroxyl group, the organic group (R), and carboxyl group.

R represents an organic group, such as a hydrocarbon group, an alkoxy group, and a dialkylamino group. R preferably represents a hydrocarbon group. When a plurality of R are present, the plurality of R may be the same with each other or different from each other. The hydrocarbon group is not particularly limited and may be any of a hydrocarbon group of a chain structure, such as an alkyl group and an alkenyl group; a hydrocarbon group of a cyclic structure, such as a cycloalkyl group and a cycloalkenyl group; and an aromatic hydrocarbon group, such as phenyl group and naphthyl group. The hydrocarbon group is preferably a hydrocarbon group of a chain structure, such as an alkyl group and an alkenyl group. The hydrocarbon group may be substituted with other hydrocarbon groups, such as lower alkyl groups, cycloalkyl groups, and phenyl group. The hydrocarbon group includes hydrocarbon groups substituted with a group which is not a hydrocarbon group as long as the hydrocarbon group substantially retains the properties of a hydrocarbon group. Examples of the group which is not a hydrocarbon group include nitro group, amino group, halo groups, hydroxyl group, lower alkoxy groups, lower alkylmercapto groups, oxo group, thio group, and bridging groups, such as —NH—, —O—, and —S—.

Preferable examples of R include linear or branched alkyl groups having 6 to 50 carbon atoms, such as hexyl group, 1-methylhexyl group, 2,3,5-trimethylheptyl group, octyl group, 3-ethyloctyl group, 4-ethyl-5-methyloctyl group, nonyl group, decyl group, dodecyl group, 2-methyl-4-ethyldodecyl group, hexadecyl group, octadecyl group, eicosyl group, docosyl group, and tetracontyl group; and linear or branched alkyl groups having 6 to 100 carbon atoms which are derived from olefin polymers, such as polyethylene, polypropylene, polyisobutylene, and ethylene-propylene copolymers.

The alcohol having 2 to 80 carbon atoms may be an aliphatic alcohol or an aromatic alcohol and may be a monohydric alcohol or a polyhydric alcohol. Examples of the aliphatic alcohol include linear or branched monohydric alcohols having 2 to 24 carbon atoms, such as hexanol, octanol, decanol, dodecanol, tetradecanol, hexadecanol, octadecanol, oleyl alcohol, linolenyl alcohol, lauryl alcohol, myristyl alcohol, cetyl alcohol, stearyl alcohol, and behenyl alcohol; relatively higher monohydric alcohols prepared by the oxo process, such as 2-ethylhexyl alcohol; relatively higher monohydric alcohols obtained by the aldol condensation or by oligomerization of α-olefins, such as ethylene and propylene, by using an organoaluminum catalyst followed by oxidation of the products; alcohols having cycloalkyl groups, such as cyclopentanol, cyclohexanol, and cyclododecanol; polyhydric alcohols, such as ethylene glycol, propylene glycol, butylene glycol, pentylene glycol, hexylene glycol, heptylene glycol, 2-ethyl-1,3-trimethylene glycol, neopentyl glycol, diethylene glycol, relatively higher polyethylene glycols and polypropylene glycols, tripropylene glycol, dibutylene glycol, dipentylene glycol, dihexylene glycol, and diheptylene glycol; sugars represented by the general formula $HOCH_2(CHOH)_nCH_2OH$, such as glycerol, sorbitol, and mannitol; pentaerythritol; oligomers of pentaerythritol, such as dipentaerythritol and tripentaerythritol; and methylolpolyols, such as trimethylolethane and trimethylolpropane.

Examples of the aromatic alcohol include monohydric alcohols, such as phenol, alkylphenols, naphthols, and alkylnathphols; dihydric alcohols, such as catechol, alkylcatechols, sulfurized alkylphenols, and alkylphenols crosslinked with methylene group; and trihydric alcohols, such as trihydroxybenzene and trihydroxyalkylbenzenes.

As the alcohol component in the ester, an aromatic alcohol is preferable, and an aromatic alcohol substituted with an alkyl group, such as an alkylphenol, an alkylcatechol, and a trihydroxyalkylbenzene, is more preferable from the standpoint of the property of the obtained ester. As the alkyl group, an alkyl group having 1 to 24 carbon atoms is preferable, and an alkyl group having 6 to 20 carbon atoms is more preferable. The alkyl group may be linear or branched. The aromatic alcohol may have 1 to 3 substituents and preferably has one substituent.

In the present invention, specific examples of the ester used as component (c) include compounds shown in the following:

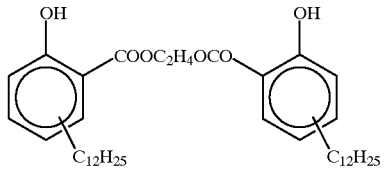

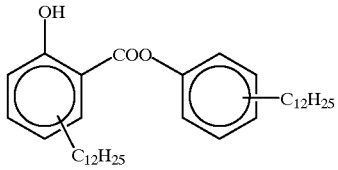

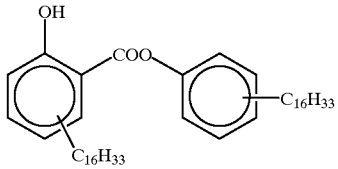

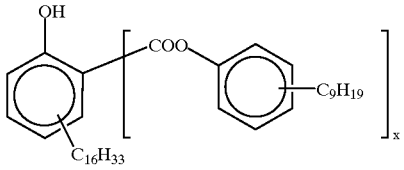

(x represents a real number of 1 to 2)

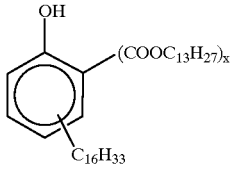

(x represents a real number of 1 to 2)

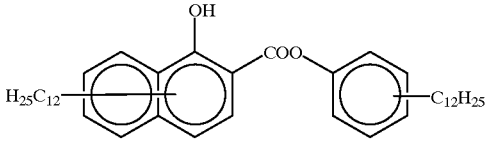

The compound containing boron which is derived from the above ester is obtained by treating the ester with a boron compound. Examples of the boron compound include boric acid, boric anhydride, boron halides, boric acid esters, boric acid amide, and boron oxide.

In the lubricating oil composition of the present invention, a single compound or a combination of two or more compounds selected from the above esters and compounds containing boron may be used as component (c). The amount is preferably selected in the range of 0.1 to 30% by weight based on the total amount of the composition. When the amount is less than 0.1% by weight, the effect of adding component (c) is not sufficiently exhibited. When the amount is more than 30% by weight, viscosity at low temperatures is increased. Thus, such an amount is not preferable. From the standpoint of the effect and the suitable viscosity, the amount of component (c) is more preferably in the range of 0.5 to 20% by weight, most preferably in the range of 1 to 10% by weight.

In the lubricating oil composition of the present invention, it is necessary that the ratio [B]/[M] of the content of boron [B] in the composition in % by weight to the total content of metals [M] derived from the metallic detergent in the composition in % by weight be not less than 0.15, and the sulfated ash content in the composition be not more than 1.5% by weight. When the ratio [B]/[M] is less than 0.15, the effect of improving the resistance to coking and the oxidation stability is insufficient, and the object of the present invention is not achieved. From the standpoint of the resistance to coking and the oxidation stability, the ratio [B]/[M] is preferably not less than 0.20. The content of boron [B] in the composition is preferably not less than 0.05% by weight. When the content of metals [B] is less than 0.05% by weight, the engine is not kept sufficiently clean, occasionally. Increase in the content [B] means increase in the content of component (a) and also in the content of component (c) when the compound containing boron derived from the ester is used, and viscosity of the composition is increased as the result. Therefore, from the standpoint of the property to keep an engine clean and the suitable viscosity, the content of boron [B] is more preferably in the range of 0.05 to 1.0% by weight, most preferably in the range of 0.05 to 0.5% by weight.

In the lubricating oil of the present invention, it is necessary that the sulfated ash content in the composition be not more than 1.5% by weight. When the sulfated ash content is more than 1.5% by weight, troubles, such as clogging of an apparatus for exhaust gas treatment, occurs. It is preferable for preventing such troubles that the sulfate ash content is not more than 1.2% by weight.

In the lubricating oil composition of the present invention, additives, such as antioxidant-antiwear agents, viscosity index improvers, pour point depressants, oiliness improvers, rust preventives, ashless antioxidants, surfactants, defoaming agents, and friction modifiers, may be comprised in accordance with application, where necessary, within the range that the object of the present invention is not adversely affected.

Among these additives, antioxidant-antiwear agents, viscosity index improvers, and pour point depressants are particularly preferably used. As the antioxidant-antiwear agent, zinc dithiophosphates (ZnDTP) are preferable. Examples of the zinc dithiophosphate include zinc primary-alkyldithiophosphates, zinc secondary-alkyldithiophosphates, zinc alkyl-substituted aryldithiophosphates, and zinc aryldithiophosphates. More specific examples of the zinc dithiophosphate include primary- or secondary-alkyldithiophosphates having a linear or branched hydrocarbon group having 3 to 18 carbon atoms and aryl- or alkyl-substituted aryldithiophosphates having phenyl group or phenyl group substituted with an alkyl group having 1 to 18 carbon atoms.

Examples of the viscosity index improver include polymethacrylates, polymethacrylates of the dispersion type, olefin copolymers, such as ethylene-propylene copolymer, olefin copolymers of the dispersion type, and styrenic copolymers, such as hydrogenated styrene-diene copolymers. Examples of the pour point depressant include polymethacrylates.

Examples of the ashless antioxidant include amine antioxidants, such as alkylated diphenylamines, phenyl-α-naphthylamine, and alkylated α-naphthylamines; and phenolic antioxidants, such as 2,6-di-t-butyl-4-methylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-thiobis(2-methyl-6-t-butylphenol), 4,4'-thiobis(3-methyl-6-t-butylphenol), and 2,2'-thiobis(4-methyl-6-t-butylphenol).

As described above, the lubricating oil composition for internal combustion engines of the present invention has a low ash content, does not show adverse effects on the performance of apparatuses for exhaust gas treatment, such as oxidation catalysts or PM traps, exhibits excellent resistance to coking and oxidation stability, and is advantageously used for Diesel engines and gas heat pumps (GHP).

The present invention is described in more detail with reference to examples. However, the present invention is not limited by the examples.

The properties of a lubricating oil composition were evaluated in accordance with the following methods:

(1) Hot tube test

An oil for the test and the air were continuously passed through a glass tube having a diameter of 2 mm in a speed of 0.3 ml/hr and 10 ml/min, respectively, for 16 hours while the tube was kept at a temperature of 310° C. The appearance of lacquer attached to the inner surface of the tube was matched with color samples. The result of the matching was evaluated as 10 when the appearance was transparent and as 0 when the appearance was black. A larger number shows better property.

(2) ISOT (Indiana Stirring Oxidation Test: a test of oxidation stability of lubricating oil for internal combustion engines)

The test was conducted under a condition of 165.5° C. and 72 hours in accordance with the method of Japanese Industrial Standard K-2514, and the base number (the hydrochloric acid method) of the sample after the test was obtained.

(3) Sulfated ash content

The sulfated ash content was obtained in accordance with the method of Japanese Industrial Standard K-2272.

EXAMPLES 1 TO 7 AND COMPARATIVE EXAMPLES 1 TO 5

Lubricating oil compositions were prepared in accordance with the formulations shown in Table 1, and the properties of the obtained compositions were evaluated. The results are shown also in Table 1.

TABLE 1 - 1

| | Example 1 | Example 2 | Example 3 |
|---|---|---|---|
| Lubricating oil composition formulation (% by weight) base oil[1)] | 87.8 | 87.3 | 83.7 |
| (a) ashless dispersant containing boron[2)] | 3.0 | 3.0 | 6.0 |
| ashless dispersant not | — | — | — |

TABLE 1 - 1-continued

| | Example 1 | Example 2 | Example 3 |
|---|---|---|---|
| containing boron[3] | | | |
| (b) Ca phenate 250TBN[4] | 2.4 | — | — |
| Ca salicylate 170TBN | — | — | 3.5 |
| Ca sulfonate 300TBN | — | 2.9 | — |
| (c) ester 1[5] | — | — | — |
| ester2[6] | — | — | — |
| ZnDTP, VII, and PPD[7] | 6.8 | 6.8 | 6.8 |
| [M] (% by wt.) | 0.23 | 0.32 | 0.21 |
| [B] (% by wt.) | 0.06 | 0.06 | 0.12 |
| [B]/[M] | 0.26 | 0.19 | 0.57 |
| sulfated ash content (% by wt.) | 1.1 | 1.4 | 1.1 |
| base number (HCl method) (mgKOH/g) | 7.0 | 9.6 | 8.6 |
| Properties | | | |
| hot tube test | 4 | 3 | 5 |
| base number after ISOT (mgKOH/g) | 1.5 | 1.0 | 1.5 |

TABLE 1 - 2

| | Example 4 | Example 5 | Example 6 |
|---|---|---|---|
| Lubricating oil composition formulation (% by weight) | 83.2 | 83.2 | 82.5 |
| base oil[1] | | | |
| (a) ashless dispersant containing boron[2] | 5.0 | 5.0 | 6.0 |
| ashless dispersant not containing boron[3] | — | — | — |
| (b) Ca phenate 250TBN[4] | — | — | 1.0 |
| Ca salicylate 170TBN | 3.0 | 3.0 | 1.7 |
| Ca sulfonate 300TBN | — | — | — |
| (c) ester 1[5] | — | 2.0 | 2.0 |
| ester2[6] | 2.0 | — | — |
| ZnDTP, VII, and PPD[7] | 6.8 | 6.8 | 6.8 |
| [M] (% by wt.) | 0.18 | 0.18 | 0.19 |
| [B] (% by wt.) | 0.10 | 0.10 | 0.12 |
| [B]/[M] | 0.56 | 0.56 | 0.63 |
| sulfated ash content (% by wt.) | 1.0 | 1.0 | 1.0 |
| base number (HCl method) (mgKOH/g) | 7.6 | 7.7 | 8.1 |
| Properties | | | |
| hot tube test | 6 | 7 | 6 |
| base number after ISOT (mgKOH/g) | 2.1 | 2.5 | 1.9 |

TABLE 1 - 3

| | Example 7 | Comparative Example 1 | Comparative Example 2 |
|---|---|---|---|
| Lubricating oil composition formulation (% by weight) | 85.0 | 87.2 | 86.2 |
| base oil[1] | | | |
| (a) ashless dispersant containing boron[2] | 3.5 | 1.0 | 1.5 |
| ashless dispersant not containing boron[3] | — | 3.0 | 3.0 |
| (b) Ca phenate 250TBN[4] | — | — | 2.5 |
| Ca salicylate 170TBN | 1.5 | — | — |
| Ca sulfonate 300TBN | 1.2 | 2.0 | — |
| (c) ester 1[5] | 2.0 | — | — |
| ester2[6] | — | — | — |
| ZnDTP, VII, and PPD[7] | 6.8 | 6.8 | 6.8 |
| [M] (% by wt.) | 0.23 | 0.24 | 0.23 |
| [B] (% by wt.) | 0.07 | 0.02 | 0.03 |
| [B]/[M] | 0.30 | 0.08 | 0.13 |
| sulfated ash content (% by wt.) | 1.1 | 1.1 | 1.1 |
| base number (HCl method) (mgKOH/g) | 7.6 | 7.8 | 8.0 |
| Properties | | | |

TABLE 1 - 3-continued

| | Example 7 | Comparative Example 1 | Comparative Example 2 |
|---|---|---|---|
| hot tube test | 6 | 1 | 1 |
| base number after ISOT (mgKOH/g) | 2.0 | 0 | 0 |

TABLE 1 - 4

| | Comparative Example 3 | Comparative Example 4 | Comparative Example 5 |
|---|---|---|---|
| Lubricating oil composition formulation (% by weight) | 85.7 | 88.2 | 85.7 |
| base oil[1] | | | |
| (a) ashless dispersant containing boron[2] | — | — | 1.0 |
| ashless dispersant not containing boron[3] | 2.0 | 2.0 | 3.0 |
| (b) Ca phenate 250TBN[4] | 2.5 | — | — |
| Ca salicylate 170TBN | — | — | 3.5 |
| Ca sulfonate 300TBN | 3.0 | 3.0 | — |
| (c) ester 1[5] | — | — | — |
| ester2[6] | — | — | — |
| ZnDTP, VII, and PPD[7] | 6.8 | 6.8 | 6.8 |
| [M] (% by wt.) | 0.58 | 0.35 | 0.21 |
| [B] (% by wt.) | 0 | 0 | 0.02 |
| [B]/[M] | 0 | 0 | 0.10 |
| sulfated ash content (% by wt.) | 2.2 | 1.4 | 1.0 |
| base number (HCl method) (mgKOH/g) | 14.0 | 8.7 | 7.6 |
| Properties | | | |
| hot tube test | 5 | 1 | 1 |
| base number after ISOT (mgKOH/g) | 0.3 | 0.1 | 0.6 |

[1]Mixture of oil of 100N (neutral) and oil of 150N; kinernatic viscosity at 100° C., 5 $mm^2$/sec
[2]Polybutenylsuccinimide containing boron
[3]Polybutenylsuccinimide
[4]TBN: Total base number (perchloric acid tnethod, mg KOH/g)
[5]Dodecylphenyl dodecylsalicylate
[6]Glycol dodecylsalicylate
[7]ZnDTP: zinc primary- and secondary-dithiophosphates
VII (viscosity index improver): olefinic copolymer
PPD (pour point depressant): polymethacrylate

INDUSTRIAL APPLICABILITY

The lubricating oil composition for internal combustion engines of the present invention has a low ash content, does not show adverse effects on the performance of apparatuses for exhaust gas treatment, exhibits excellent resistance to coking and oxidation stability, and is advantageously used for Diesel engines and gas heat pumps (GHP).

We claim:

1. A lubricating oil composition for internal combustion engines which comprises a base oil, (a) an ashless dispersant containing boron, and (b) a metallic detergent which is comprised of a mixture of at least one compound selected from the group consisting of alkali metal salicylates and alkaline earth metal salicylates and at least one compound selected from the group consisting of alkali metal phenates, alkaline earth metal phenates, alkali metal sulfonates, and alkaline earth metal sulfonates, wherein a ratio [B]/[M] of a content of boron [B] in the composition in % by weight to a total content of metals [M] derived from the metallic detergent in the composition in % by weight is not less than 0.15, and a sulfated ash content in the composition is not more than 1.5% by weight.

2. A lubricating oil composition for internal combustion engines which comprises a base oil, (a) an ashless dispersant containing boron, (b) a metallic detergent, and (c) at least one selected from a group consisting of esters of aromatic carboxylic acids having hydroxyl group and hydroxy compounds and compounds containing boron which are derived from the esters, wherein a ratio [B]/[M] of a content of boron [B] in the composition in % by weight to a total content of metals [M] derived from the detergent in the composition in % by weight is not less than 0.15, and a sulfated ash content in the composition is not more than 1.5% by weight.

3. A lubricating oil composition according to claim 1, wherein the ratio [B]/[M] is not less than 0.20.

4. A lubricating oil composition according to claim 1, wherein the content of boron [B] is not less than 0.05% by weight.

5. A lubricating oil composition according to claim 2, wherein the metallic detergent of component (b) is at least one selected from [a] the group consisting of alkali metal salicylates and alkaline earth metal salicylates.

6. A lubricating oil composition according to claim 2, wherein the metallic detergent component (b) is a mixture of at least one selected from the group consisting of alkali metal salicylate and alkaline earth metal salicylates and at least one selected from the group consisting of alkali metal phenates, alkaline earth metal phenates, alkali metal sulfonates, and alkaline earth metal sulfonates.

7. A lubricating oil composition according to claim 2, wherein component (c) is at least one selected from a group consisting of esters of aromatic carboxylic acids having hydroxyl group and alcohols having 2 to 80 carbon atoms and compounds containing boron which are derived from the esters.

8. A lubricating oil composition according to claim 2, wherein component (c) is at least one selected from a group consisting of esters of aromatic carboxylic acids having hydroxyl group and aromatic alcohols substituted with an alkyl group and compounds containing boron which are derived from the esters.

9. A lubricating oil composition according to claim 2, wherein the aromatic carboxylic acid having hydroxyl group for the ester of component (c) is a compound represented by the general formula (I):

(I)

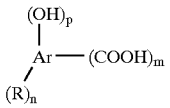

wherein Ar represents a polyvalent aromatic nucleus, R represents an organic group, p represents an integer of 1 to 3, n represents an integer of 1 to 4, m represents an integer of 1 to 3, and when a plurality of R are present, the plurality of R may be the same with each other or different from each other.

10. A lubricating oil composition according to claim 2 wherein the ratio [B]/[M] is not less than 0.20.

11. A lubricating oil composition according to claim 2, wherein the content of boron [B] is not less than 0.05% by weight.

12. A lubricating oil composition according to claim 2, wherein the metallic detergent of component (b) is at least one member selected from the group consisting of alkali metal salicylates and alkaline earth metal salicylates.

13. A lubricating oil composition according to claim 2, wherein the metallic detergent of component (b) is a mixture of at least one member selected from the group consisting of alkali metal salicylates and alkaline earth metal salicylates and at least one member selected from the group consisting of alkali metal phenates, alkaline earth metal phenates, alkali metal sulfonates, and alkaline earth metal sulfonates.

14. A lubricating oil composition according to claim 7, wherein the aromatic carboxylic acid having hydroxyl group as component (c) is a compound represented by the general formula (I):

(I)

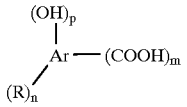

wherein Ar represents a polyvalent aromatic nucleus, R represents an organic group, p represents an integer of 1 to 3, n represents an integer of 1 to 4, m represents an integer of 1 to 3, and when a plurality of R are present, each R may be the same or different.

15. A lubricating oil composition according to claim 8, wherein the aromatic carboxylic acid having hydroxyl group for the ester of component (c) is a compound represented by the general formula (I):

(I)

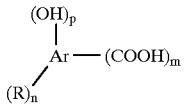

wherein Ar represents a polyvalent aromatic nucleus, R represents an organic group, p represents an integer of 1 to 3, n represents an integer of 1 to 4, m represents an integer of 1 to 3, and when a plurality of R are present, each R may be the same or different.

* * * * *

UNITED STATES PATENT AND TRADEMARK OFFICE

CERTIFICATE OF CORRECTION

PATENT NO. : 5,965,495

DATED : October 12, 1999

INVENTOR(S) : Masahisa GOTO, et al.

It is certified that error appears in the above-identified patent and that said Letters Patent is hereby corrected as shown below:

On the title page, item [75] should be:

--[75] Inventors: Masahisa Goto; Tomomi Miyaji; Keiichi Narita, all of Ichihara, Japan--

Signed and Sealed this

Twenty-first Day of November, 2000

*Attest:*

Q. TODD DICKINSON

*Attesting Officer*

*Director of Patents and Trademarks*